US007205947B2

(12) United States Patent
Parsche

(10) Patent No.: US 7,205,947 B2
(45) Date of Patent: Apr. 17, 2007

(54) LITZENDRAHT LOOP ANTENNA AND ASSOCIATED METHODS

(75) Inventor: Francis Eugene Parsche, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 223 days.

(21) Appl. No.: 10/921,644

(22) Filed: Aug. 19, 2004

(65) Prior Publication Data

US 2006/0038730 A1 Feb. 23, 2006

(51) Int. Cl.
*H01Q 11/12* (2006.01)
*H01Q 21/00* (2006.01)

(52) U.S. Cl. ..... 343/742; 343/788; 343/867

(58) Field of Classification Search ..... 343/741–744, 343/866, 788, 842, 867
See application file for complete search history.

(56) References Cited

U.S. PATENT DOCUMENTS

| | | | | |
|---|---|---|---|---|
| 1,039,717 A | | 10/1912 | Fessenden | 336/187 |
| 3,671,970 A | * | 6/1972 | Layton | 342/435 |
| 3,902,177 A | * | 8/1975 | Mori et al. | 343/741 |
| 4,433,336 A | * | 2/1984 | Carr | 343/728 |
| 4,997,992 A | * | 3/1991 | Low | 174/24 |
| H1571 H | * | 8/1996 | Hansen et al. | 343/728 |
| 5,625,370 A | * | 4/1997 | D'Hont | 343/788 |
| 6,288,375 B1 | * | 9/2001 | Lappi et al. | 219/633 |
| 6,359,594 B1 | * | 3/2002 | Junod | 343/744 |
| 6,567,050 B1 | * | 5/2003 | Briggs | 343/741 |
| 6,960,984 B1 | * | 11/2005 | Vicci et al. | 340/10.1 |
| 2003/0015479 A1 | * | 1/2003 | Kuennen et al. | 210/748 |
| 2005/0029919 A1 | * | 2/2005 | Notohara et al. | 313/326 |

FOREIGN PATENT DOCUMENTS

| | | | |
|---|---|---|---|
| JP | 2001292018 | * | 10/2001 |
| JP | 2003224415 | * | 8/2003 |

OTHER PUBLICATIONS

Definition of "Litz wire"; McGraw-Hill Encyclopedia of Science & Technology Online.*
Definition of "Litz Wire"; McGraw-Hill Encyclopedia of Science & Technology Online; Sep. 30, 2003.*
New England Wire Technologies, "Litz Wire Technical Information", Apr. 5, 2003, pp. 1-20.

* cited by examiner

*Primary Examiner*—Tan Ho
(74) *Attorney, Agent, or Firm*—Allen, Dyer, Doppelt, Milbrath & Gilchrist, P.A.

(57) ABSTRACT

The antenna includes a Litz wire loop having a plurality of individually insulated wires braided together and a plurality of splices therein to define distributed capacitors. A magnetically coupled feed loop is provided within the electrically conductive loop, and a feed structure, such as a coaxial feed line, feeds the magnetically coupled feed loop.

34 Claims, 5 Drawing Sheets

LITZENDRAHT LOOP ANTENNA AND ASSOCIATED METHODS

FIELD OF THE INVENTION

The present invention relates to the field of antennas, and more particularly, this invention relates to loop antennas with increased gain and related methods.

BACKGROUND OF THE INVENTION

Newer designs and manufacturing techniques have driven electronic components to small dimensions and miniaturized many communication devices and systems. Unfortunately, antennas have not been reduced in size at a comparative level and often are one of the larger components used in a smaller communications device. In those communication applications at below 6 GHz frequencies, the antennas become increasingly larger. At very low frequencies, for example, used by submarines or other low frequency communication systems, the antennas become very large, which can be unacceptable. It becomes increasingly important in these communication applications to reduce not only antenna size, but also to design and manufacture a reduced size antenna having a relatively high gain for a relatively small area.

In present day communications devices, many different types of patch antennas, loaded whips, copper windings (helix and spiral) and dipoles are used in a variety of different ways. These antennas, however, are sometimes large and impractical for a specific application.

Printed circuit or microstrip patch antennas can be manufactured at low costs and have been developed as antennas for the mobile communication field. The flat antenna or thin antenna is configured, for example, by disposing a patch conductor cut to a predetermined size over a grounded conductive plate through a dielectric material. This structure allows an antenna with high efficiency in a several GHz frequency band to be fabricated in a relatively simple structure. Such an antenna can be easily mounted to appliances, such as a printed circuit board (PCB).

Loop antennas are another form of small antenna. They can be formed of copper rod or tubing bent into a circle. Low operating frequencies can be accomplished by placing a loading capacitor at a discontinuity in the loop ring. At lower and lower frequencies however, the radiation resistance of the loop becomes less than the conductor loss resistance, and low radiation efficiency and gain results. Metals exhibit finite conductivities at room temperature, and conductor loss resistance is a fundamental limitation to the gain and efficiency of small antennas.

However, none of these approaches focuses on reducing the size of the antenna, by providing increasing efficiency and gain in a smaller area. Furthermore, antennas with solid metal conductors suffer from RF skin effect which is a tendency for alternating current (AC) to flow mostly near the outer surface of a solid electrical conductor as the frequency increases. RF skin effect greatly reduces the useful amount of conductor cross section, e.g. in a loading coil wire or loop antenna ring. RF skin effect is a limitation to the gain and efficiency of small antennas.

SUMMARY OF THE INVENTION

In view of the foregoing background, it is therefore an object of the present invention to provide an antenna with reduced RF skin effect and increased radiation efficiency and gain.

This and other objects, features, and advantages in accordance with the present invention are provided by an antenna including a Litz wire loop having a plurality of wires braided together and a plurality of splices therein to define distributed capacitors. A feed loop is provided adjacent or within the Litz wire loop and is preferably magnetically coupled thereto. A feed structure, such as a coaxial transmission line, is connected to and feeds the feed loop. The plurality of wire are preferably individually insulated wires, and the Litz wire construction may be braided and/or twisted. The litz wire may be served or unserved.

An outer shield, such as a coaxial electrostatic shield, may surround the electrically conductive loop. The plurality of wires may include a plurality of groups of wires, the wires in a group being braided or twisted together, and the plurality of groups being braided or twisted together. The plurality of wires may comprise about 1700–1900 strands of insulated #37–39 AWG (American Wire Gauge) wire. In another instance, the plurality of wires may comprise 32,000 strands of #52 AWG wire.

Other objects, features, and advantages in accordance with the present invention are provided by a method of making an antenna including forming a Litz wire loop having a plurality of wires braided or twisted together, and providing distributed capacitors by forming a plurality of splices in the Litz wire loop. The method includes providing a feed loop within the electrically conductive loop, and forming a feed structure to feed the feed loop. The method may also include tuning the frequency of the electrically conductive loop by breaking or connecting selected wires of the plurality of wires.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout, and prime notation is used to indicate similar elements in alternative embodiments.

Figure 1:
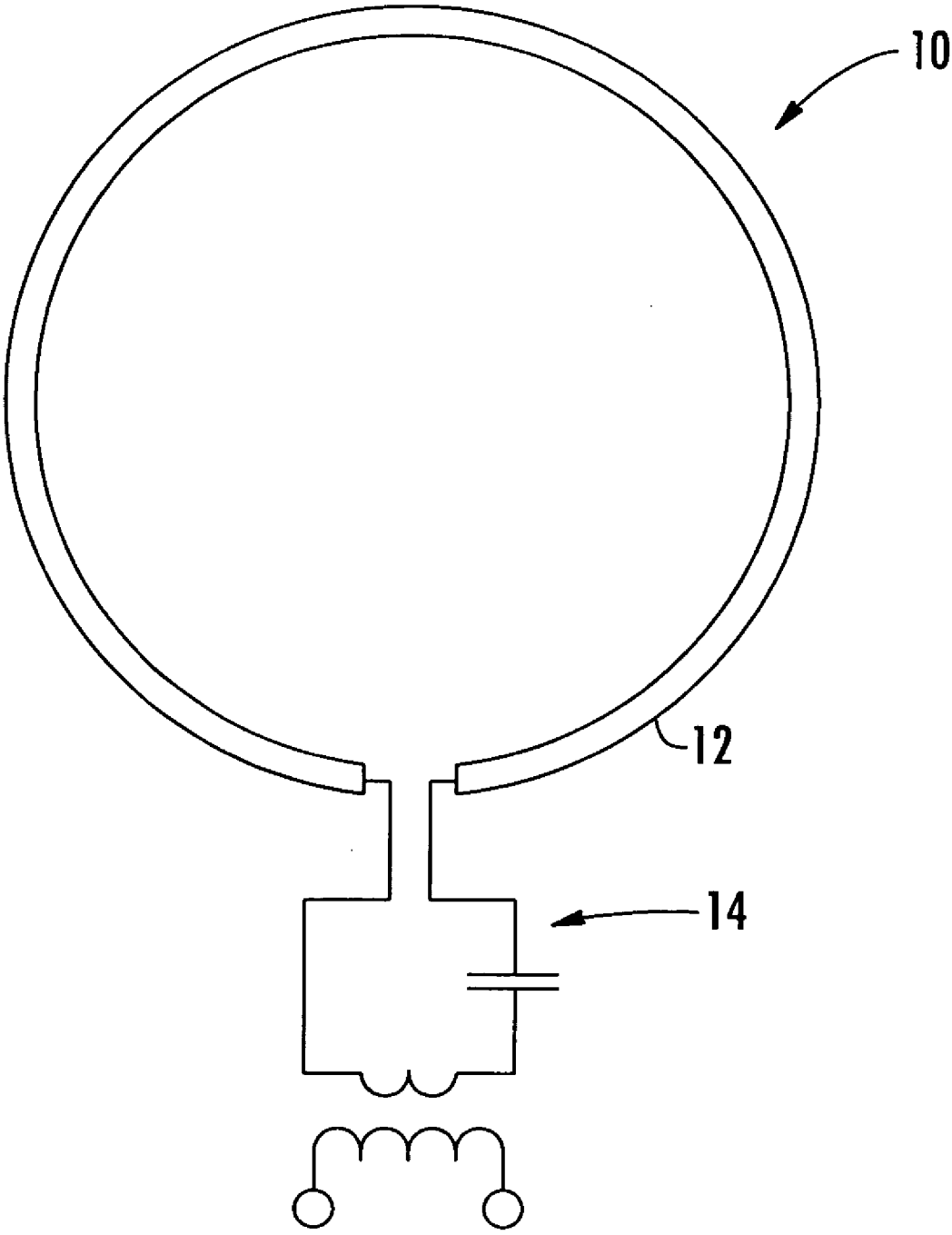
FIG. 1 (PRIOR ART)
FIG. 1 is a schematic diagram of a loop antenna having a single solid conductor as in the prior art.
Figure 2:
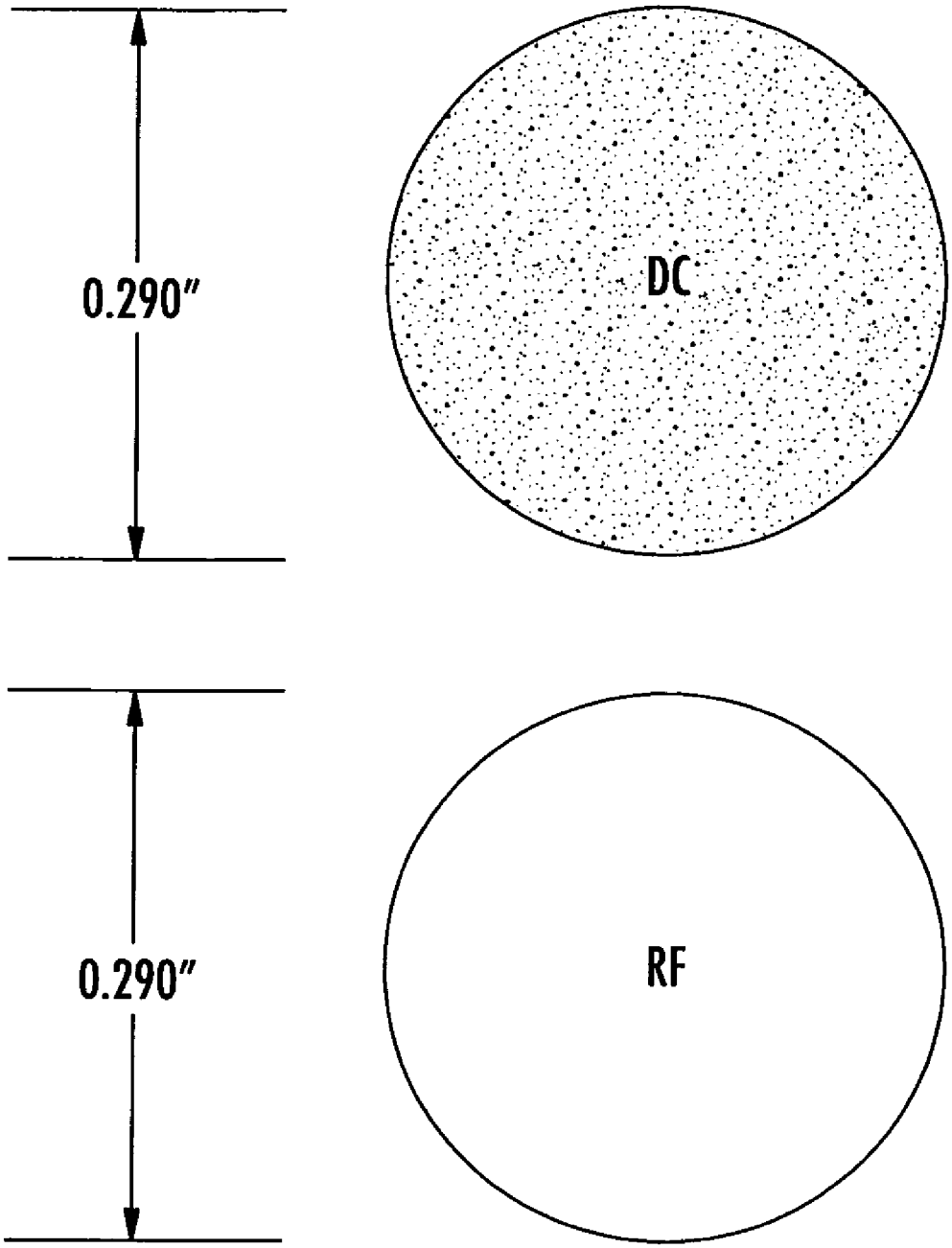
FIG. 2 is a schematic diagram illustrating the Rf skin effect in the single solid conductor of the antenna of FIG. 1.

Referring initially to FIG. 1, a conventional loop antenna 10 will be described. The loop antenna 10 has a solid metal conductor 12 and feed structure 14. As described above, and further illustrated in FIG. 2, solid metal conductors suffer from RF skin effect which is a tendency for current to flow mostly near the outer surface of a solid electrical conductor as the frequency increases. At DC, the effective conductive area of a 0.29 inch diameter solid conductor, for example, is about 0.066 square inches. The entire cross section of the solid conductor is useful at DC. At radio frequencies and in copper, one skin depth at 6 Mhz=1.8 Mils, which results in an effective conductive area for RF signals of approximately 0.002 square inches which is about 72× less than the actual cross-sectional area of the solid conductor. This results in a non-efficient antenna. For example, 18 dB of gain loss can be attributed to RF skin effect.

Figure 3:
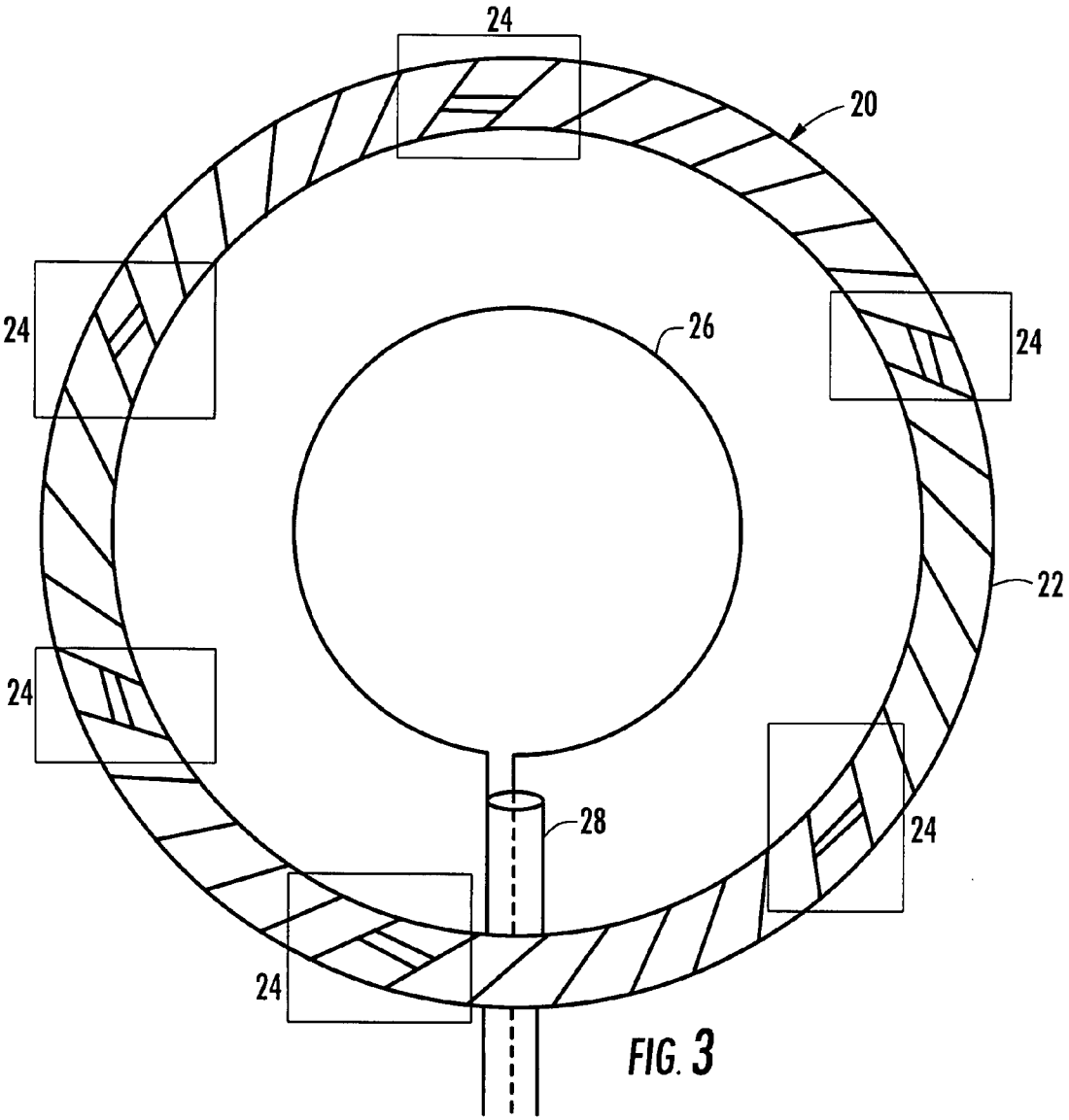
FIG. 3 is a schematic diagram of an antenna in accordance with the present invention.
Figure 4:
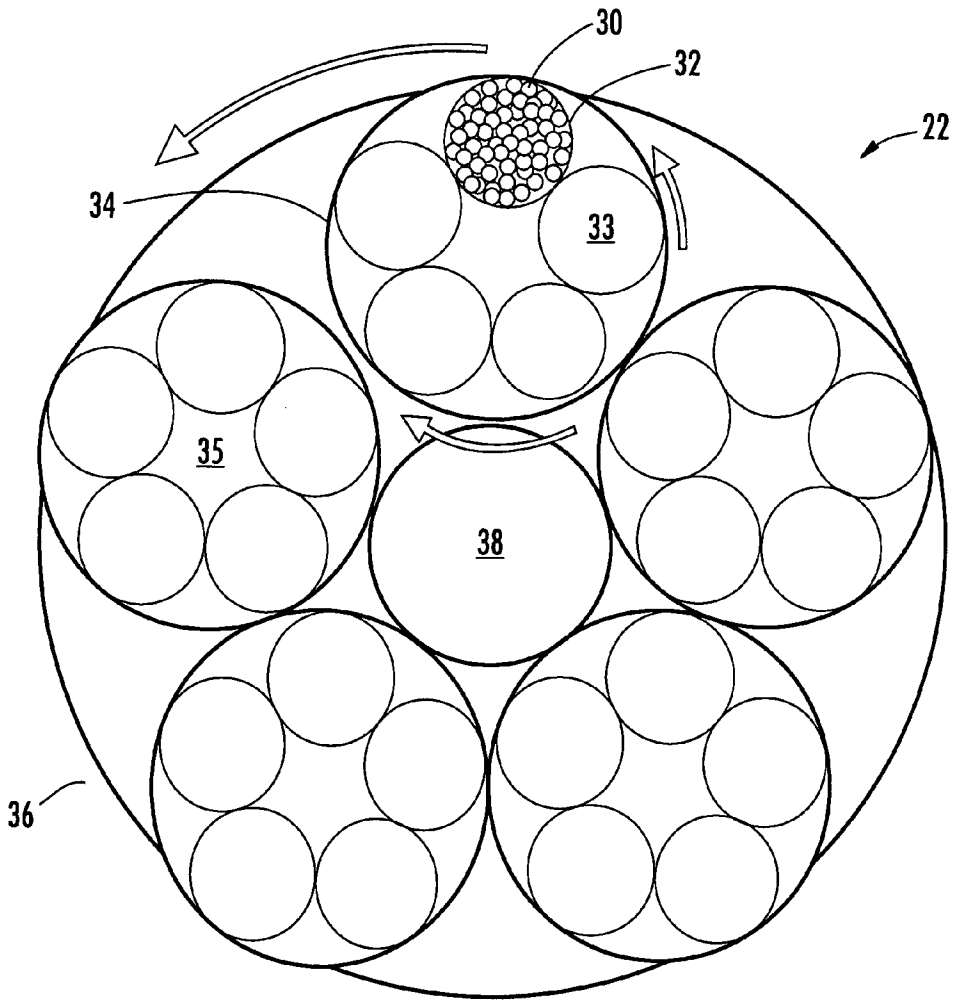
FIG. 4 is a cross-sectional view of the Litz wire conductive loop of the antenna of FIG. 3.

With reference to FIGS. 3 and 4, an embodiment of the antenna 20 in accordance with the present invention will be described. The antenna 20 includes a Litz wire loop 22. The term Litz wire is derived from the German word Litzendraht (or Litzendraught) meaning woven or "lace" wire. Generally defined, it is a wire constructed of individual film insulated wires bunched and twisted or braided together in a uniform pattern. Litz wire construction is designed to minimize or reduce the power losses exhibited in solid conductors due to the skin effect, which, as mentioned, is the tendency of radio frequency current to be concentrated at the surface of the conductor. Litz constructions counteract this effect because each strand occupies all possible positions in the cable, which equalizes the flux linkages. This allows current to flow throughout the cross section of the cable. Generally speaking, constructions composed of many strands of finer wires are best for the higher frequency applications, with strand diameters of 1 to 2 skin depths being particularly efficient.

When choosing a Litz wire for a given application, there are a number of important specifications to consider which will affect the performance of the wire. These specifications include the number of wire strands wound into the Litz wire, the frequency range of the wire, the size of the strands (generally expressed in AWG—American Wire Gauge), the resistance of the wire, its weight, and its shape (generally, either round, rectangular or braided).

Various Litz wire constructions are useful. In the Litz wire loop 22, type 4 and type 2 constructions are illustrated. The invention is not so limited however, and any of the various Litz wire constructions may be used. For instance, the bundles may be braided, and the cable twisted. In other instances, braiding or twisting may be used throughout.

Litz wire may be served or unserved. Served simply means that the entire Litz construction is wrapped with a nylon textile, polyurethane, or yarn for added strength and protection. Unserved wires have no wrapping or insulation. In either case, additional tapes or insulations may be used to help secure the Litz wire and protect against electrical interference. Polyurethane is the film most often used for insulating individual strands because of its low electrical losses and its solderability. Other insulations can also be used.

Typical applications for Litz wire conductors include high-frequency inductors and transformers, variometers, inverters, power supplies, DC/DC converters, communications equipment, ultra-sonic equipment, sonar equipment, magnetic resonance imaging equipment, and heat induction equipment.

As shown in the embodiment of FIGS. 3 and 4, the Litz wire loop 22 has a plurality of wires 30 braided together and a plurality of splices 24 in the Litz wire to define distributed capacitors therein. The splices 24 are preferably an electrical discontinuity in the Litz wire loop 22 with the respective portions being mechanically aligned and held in position. A magnetically coupled feed loop 26 is provided within the Litz wire loop 22, and a feed structure 28, such as a coaxial feed line, feeds the magnetically coupled feed loop. The inner magnetically coupled feed loop 26 acts as a broadband coupler and is non-resonant. The outer electrically conductive Litz wire loop is resonant and radiates. The feed loop 26 may also be in other positions adjacent the Litz wire loop 22 as will be appreciated by those skilled in the art.

The plurality of wires 30 are preferably individually insulated wires, such as single film-insulated wire strand with an outer insulation 32 of textile yarn, tape or extruded compounds to form an insulated bundle 33. Dielectric strands, 31, may be included with the plurality of wires 30. Groups 35 of insulated bundles 33 may be braided or twisted together and include an outer insulation 34. The groups 35 may also be braided or twisted together to define the Litz wire loop 22 with a further outer insulation 36. In a preferred embodiment, the Litz wire includes about 1700–1900 strands of insulated wire between about #36 and #40 AWG (American Wire Gauge), and more preferably about 1800 strands of insulated #38 AWG wire.

Common magnet wire film insulations such as polyvinylformal, polyurethane, polyurethane/Nylon, solderable polyester, solderable polyester/Nylon, polyester/polyamide-imide, and polyimide are normally used. The outer insulation and the insulation on the component conductors, in some styles, may be servings or braids of Nylon, cotton, Nomex, fiberglass or ceramic. Polyester, heat sealed polyester, polyimide, and PTFE tape wraps along with extrusions of most thermoplastics are also available as outer insulation if the applications dictate special requirements for voltage breakdown or environmental protection.

Many conductive materials can form the various strands 30. For instance, iron and steel wire strands may be used, and insulated efficiently with black oxide insulation formed from immersion of the bare wire in phosphoric acid. The skin depth in the permeable conductive materials is reduced by $(\mu)^{-1/2}$.

The Litz wire loop 22 includes the splices 24 as capacitive elements or a tuning feature for forcing/tuning the Litz wire loop to resonance. Additionally, the frequency of the antenna 20 may be tuned by breaking and/or connecting various strands 30 in the Litz wire loop 22. Furthermore, the feed structure 28 is preferably as a coaxial feed line, for example a 50 ohm coaxial cable, to feed the antenna 20, as would be appreciated by the skilled artisan.

Figure 5:
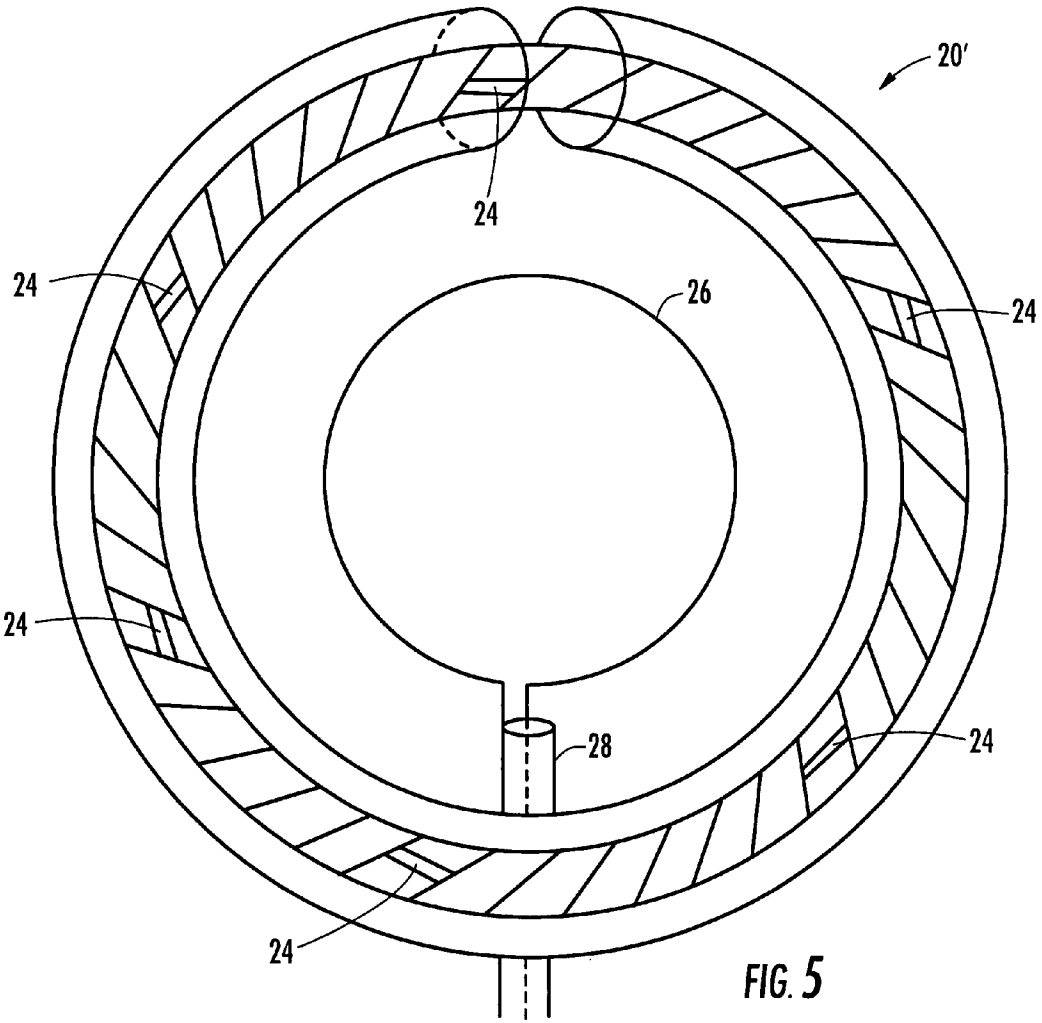
FIG. 5 is a schematic diagram of another embodiment of an antenna in accordance with the present invention.

Also, with reference to the embodiment illustrated in FIG. 5, an outer shield loop 40 may surround the Litz wire loop 22 and be spaced therefrom. The outer shield loop 40 and the Litz wire loop 22 both radiate and act as differential-type loading capacitors to each other. The distributed capacitance between the outer shield icop 40 and the Litz wire loop 22 stabilizes tuning of the antenna 20' by shielding electromagnetic fields from adjacent dielectrics, people, structures, etc.

A method aspect of the present invention is directed to making an antenna 20 and includes forming a Litz wire loop 22 having a plurality of wires 30 braided together, and providing distributed capacitors by forming a plurality of splices 24 in the Litz wire loop. The method includes providing a magnetically coupled feed loop 26 within the electrically conductive Litz wire loop 22, and forming a feed structure 28 to feed the magnetically coupled feed loop.

The method may also include tuning the frequency of the loop 22 by breaking and connecting selected wires 30 of the plurality of wires. For example, the operating frequency of a given litz wire loop construction is first determined by measuring the lowest resonant frequency at the coupled feed loop 26. The operating frequency of the litz wire loop may then be finely adjusted upwards by randomly breaking strands throughout the Litz wire loop. The operating frequency of the Litz wire loop is constantly monitored at the coupled feed loop 26 to determine when the desired operating frequency is reached. The operating frequency may be adjusted downwards by reconnecting the broken strands.

The Litz wire loop 22 may be formed in many ways. In one manual technique, multiple long splices are made, of individual wire bundles, as is common in the art of making continuous rope slings. One bundle is unraveled from the cable, and then another bundle laid into the void left by the previous bundle. The end locations of the multiple wire bundles are staggered around the circumference of the Litz wire loop 22. A core 38, shaped into a circular ring and made of dielectric, can be used as a form for the Litz wire loop 22.

The Litz wire loop 22 forms a resonant metallic microstructure. Resonance is provided by self inductance in the individual wire strands and the distributed capacitance between the strands. The mode is series resonance at the fundamental frequency.

In operation, the magnetically coupled feed loop 26 acts as a transformer primary to the Litz wire loop 22, which acts as a resonant secondary, by mutual inductance of the radial magnetic near fields passing through he loop planes. The nature of this coupling is broadband.

In high power operation, and to prevent corona discharge, it has been found advantageous to insulate the ends of the plurality of wires 30 where they are broken for splices or tuning adjustments. In one instance, polystyrene has been dissolved in toluene and applied as a paint. The invention may also, for example, be operated in a vacuum or high dielectric gas, such as Freon 12 or sulfur hexafluoride.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. An antenna comprising:

a Litz wire loop including a plurality of wires braided or twisted together and having a plurality of splices therein to define distributed capacitors;

a feed loop adjacent the Litz wire loop; and a feed structure connected to the feed loop.

2. The antenna according to claim 1 wherein the plurality of wires comprises a plurality of individually insulated wires.

3. The antenna according to claim 1 wherein the Litz wire loop further comprises a plurality of dielectric strands braided or twisted with the plurality of wires.

4. The antenna according to claim 1 wherein the Litz wire loop further comprises an inner dielectric core with the plurality of wires positioned therearound.

5. The antenna according to claim 1 wherein the Litz wire loop comprises served Litz wire.

6. The antenna according to claim 1 wherein the Litz wire loop Comprises unserved Litz wire.

7. The antenna according to claim 1 wherein the feed structure comprises a coaxial feed line.

8. The antenna according to claim 1 further comprising a coaxial electrostatic shield surrounding the Litz wire loop.

9. The antenna according to claim 1 wherein the feed loop is within the Litz wire loop and magnetically coupled thereto.

10. The antenna according to claim 1 wherein the plurality of wires comprises a plurality of groups of wires, the wires in a group being braided or twisted together, and the plurality of groups being braided or twisted together.

11. The antenna according to claim 1 wherein the plurality of wires comprises about 1700–1900 strands of insulated wire between about #36 and #40 AWG (American Wire Gauge).

12. An antenna comprising:

a Litz wire loop including a plurality of splices therein;

a magnetically coupled feed loop within the Litz wire loop;

a coaxial electrostatic shield surrounding the Litz wire loop; and a feed structure to feed the magnetically coupled feed loop.

13. The antenna according to claim 12 wherein the Lits wire loop comprises a plurality of individually insulated wires braided or twisted together.

14. The antenna according to claim 13 wherein the Litz wire loop comprises served Litz wire.

15. The antenna according to claim 13 wherein the Litz wire loop comprises unserved Litz wire.

16. The antenna according to claim 12 wherein the feed structure comprises a coaxial feed line.

17. The antenna according to claim 12 wherein the plurality of splices in the Litz wire loop define distributed capacitors therein.

18. The antenna according to claim 12 wherein the Litz wire comprises a plurality of groups of wires, the wires in a group being braided or twisted together, and the plurality of groups being braided or twisted together.

19. The antenna according to claim 12 wherein the Litz wire comprises about 1700–1900 strands of insulated wire between about #36 and #40 AWG (American Wire Gauge).

20. A method of making an antenna comprising:

forming a Litz wire loop including a plurality of wires braided or twisted together;

providing distributed capacitors by forming a plurality of splices in the Litz wire loop;

providing a feed loop adjacent the Litz wire loop; and connecting a feed structure to the feed loop.

21. The method according to claim 20 further comprising tuning the frequency of the electrically conductive loop by at least one of breaking and connecting selected wires of the plurality of wires.

22. The method according to claim 20 wherein the plurality of wires comprises a plurality of individually insulated wires.

23. The method according to claim 22 wherein the Litz wire comprises served Litz wire.

24. The method according to claim 22 wherein the Litz wire comprises unserved Litz wire.

25. The method according to claim 20 wherein the feed structure comprises a coaxial feed line.

26. The method according to claim 20 further comprising surrounding the electrically conductive loop with an outer shield.

27. The method according to claim 26 wherein the outer shield comprises a coaxial electrostatic shield.

28. The method according to claim 20 wherein the plurality of wires comprises a plurality of groups of wires, the wires in a group being braided or twisted together, and the plurality of groups being braided or twisted together.

29. The method according to claim 20 wherein the plurality of wires comprises about 1800 strands of enameled #38 AWG (American Wire Gauge) wire.

30. A conductive structure comprising:

a Litz wire loop including a plurality of wires braided or twisted together and having a plurality of splices therein to define distributed capacitors; and at least one coupling loop adjacent the Litz wire loop.

31. The conductive Structure according to claim 30 wherein the at least one coupling loop is within the Litz wire loop and magnetically coupled thereto.

32. The conductive structure according to claim 30 wherein the plurality of wires comprises a plurality of individually insulated wires.

33. The conductive stricture according to claim 30 wherein the Litz wire loop further comprises a plurality of dielectric strands braided or twisted with the plurality of wires.

34. The conductive structure according to claim 30 wherein the Litz wire loop further comprises an inner dielectric core with the plurality of wires positioned there-around.

* * * * *

UNITED STATES PATENT AND TRADEMARK OFFICE

CERTIFICATE OF CORRECTION

PATENT NO. : 7,205,947 B2
APPLICATION NO. : 10/92144
DATED : April 17, 2007
INVENTOR(S) : Parsche It is certified that error appears in the above-identified patent and that said Letters Patent is hereby corrected as shown below:

Sheet 4 of 5

Delete: "Current drawing FIG. 4"
Insert:

--

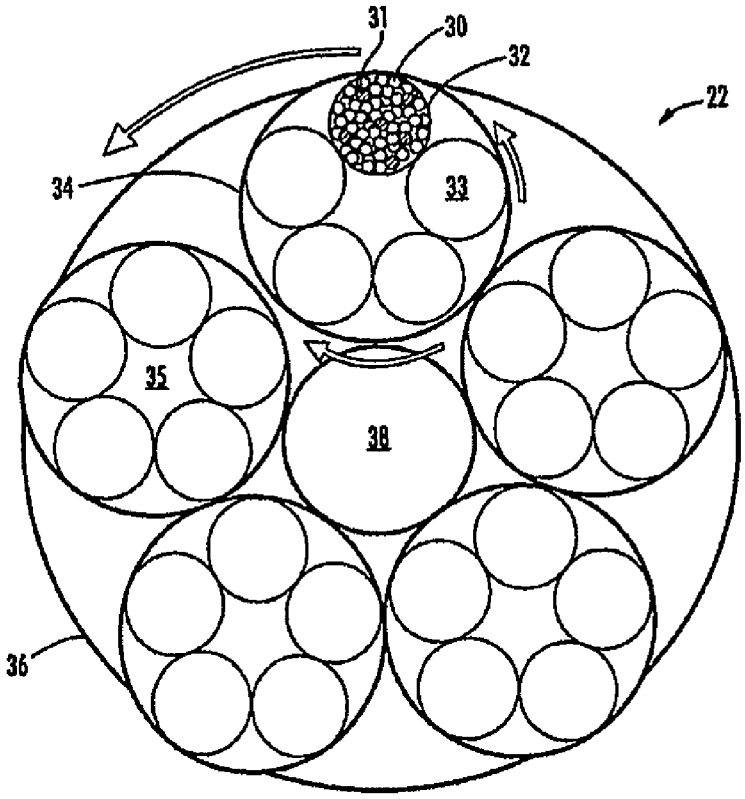

FIG. 4

--

UNITED STATES PATENT AND TRADEMARK OFFICE

CERTIFICATE OF CORRECTION

PATENT NO. : 7,205,947 B2
APPLICATION NO. : 10/921644
DATED : April 17, 2007
INVENTOR(S) : Parsche It is certified that error appears in the above-identified patent and that said Letters Patent is hereby corrected as shown below:

Sheet 5 of 5 Delete: "Current drawing FIG. 5"
-- Insert:

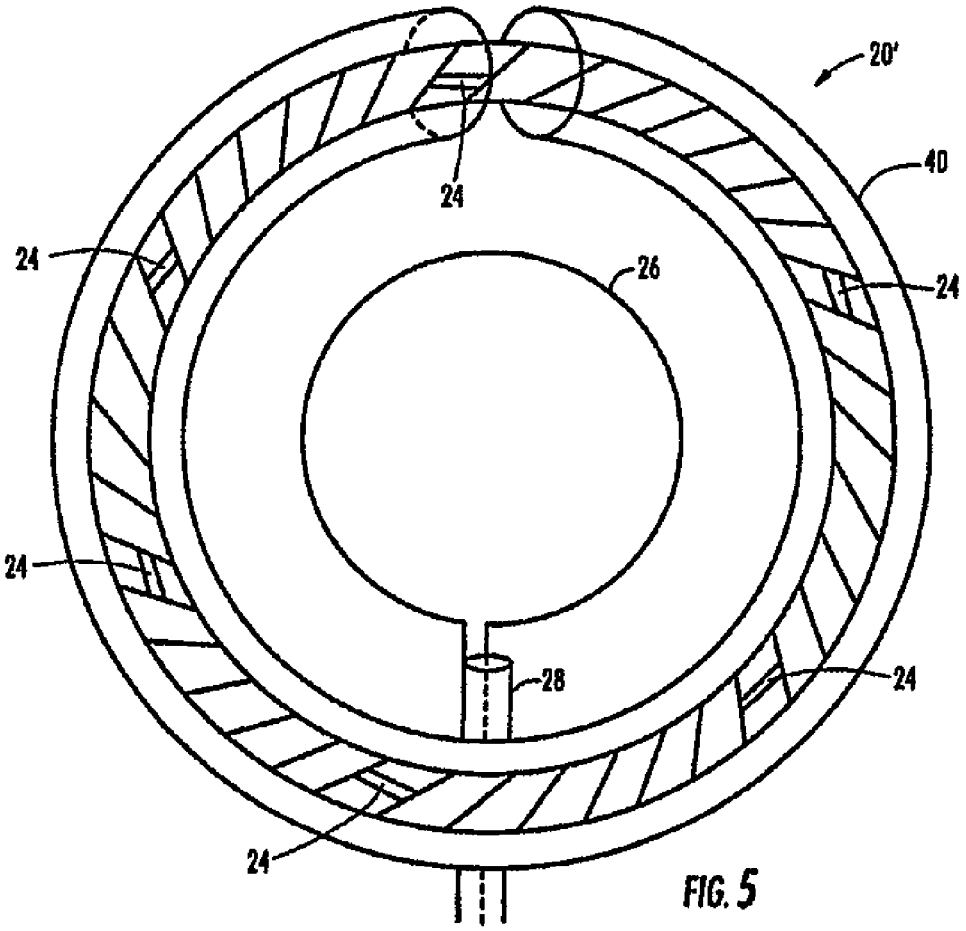

FIG. 5

--

UNITED STATES PATENT AND TRADEMARK OFFICE

CERTIFICATE OF CORRECTION

PATENT NO. : 7,205,947 B2
APPLICATION NO. : 10/921644
DATED : April 17, 2007
INVENTOR(S) : Parsche It is certified that error appears in the above-identified patent and that said Letters Patent is hereby corrected as shown below:

| | |
|---|---|
| Column 4, Lines 18-19 | Delete: " polyvinyl-formal"<br>Insert: -- polyvinyl fluoride -- |
| Column 4, Line 48 | Delete: " icop"<br>Insert: -- loop -- |
| Column 7, Line 6 | Delete: "Structure"<br>Insert: -- structure -- |
| Column 8, Line 1 | Delete: "stricture"<br>Insert: -- structure -- |

Signed and Sealed this

Twenty-eighth Day of August, 2007

JON W. DUDAS
*Director of the United States Patent and Trademark Office*